US010384843B2

(12) United States Patent
Vovan et al.

(10) Patent No.: US 10,384,843 B2
(45) Date of Patent: Aug. 20, 2019

(54) PULL-TAB TAMPER EVIDENT CONTAINER

(71) Applicant: SMART-TAB, LLC, Upland, CA (US)

(72) Inventors: Terry Vovan, Upland, CA (US); Jane Vovan, Upland, CA (US)

(73) Assignee: SMART-TAB, LLC, Upland, CA (US)

( * ) Notice: Subject to any disclaimer, the term of this patent is extended or adjusted under 35 U.S.C. 154(b) by 125 days.

(21) Appl. No.: 15/421,422

(22) Filed: Jan. 31, 2017

(65) Prior Publication Data

US 2018/0215517 A1 Aug. 2, 2018

(51) Int. Cl.

| | |
|---|---|
| ***B65D 55/02*** | (2006.01) |
| ***B65D 43/02*** | (2006.01) |
| ***B65D 43/16*** | (2006.01) |
| ***B65D 65/46*** | (2006.01) |
| ***B65D 43/22*** | (2006.01) |
| ***B65D 45/20*** | (2006.01) |

(52) U.S. Cl.

CPC ..... *B65D 55/024* (2013.01); *B65D 43/02* (2013.01); *B65D 43/0274* (2013.01); *B65D 43/162* (2013.01); *B65D 43/22* (2013.01); *B65D 45/20* (2013.01); *B65D 65/466* (2013.01); *B65D 2101/0015* (2013.01); *B65D 2101/0023* (2013.01); *B65D 2543/00194* (2013.01); *B65D 2543/00296* (2013.01); *B65D 2543/00537* (2013.01)

(58) Field of Classification Search

CPC ..... B65D 55/024; B65D 43/22; B65D 45/20; B65D 43/0274; B65D 43/02; B65D 65/466; B65D 43/162; B65D 2101/0023; B65D 2543/00296; B65D 2101/0015; B65D 2543/00537; B65D 2543/00194

See application file for complete search history.

(56) References Cited

U.S. PATENT DOCUMENTS

| | | | |
|---|---|---|---|
| 6,116,441 | A | 9/2000 | Decelles et al. |
| 6,715,632 | B2 | 4/2004 | Baker |
| 7,073,680 | B2 | 7/2006 | Boback et al. |
| 7,118,003 | B2 | 10/2006 | Sellari et al. |
| 7,475,788 | B2 | 1/2009 | Schwarz |
| 7,913,870 | B2 | 3/2011 | Vovan |
| 7,992,743 | B2 | 8/2011 | Vovan |
| 8,186,531 | B2 | 5/2012 | Parikh et al. |
| 8,371,468 | B2 | 2/2013 | Sellari et al. |

(Continued)

FOREIGN PATENT DOCUMENTS

| | | |
|---|---|---|
| CA | 2931803 | 5/2016 |
| EP | 22108191 A1 | 1/2009 |

(Continued)

*Primary Examiner* — James N Smalley

(74) *Attorney, Agent, or Firm* — Todd Juneau; Juneau & Mitchell

(57) ABSTRACT

The invention relates to a plastic container having a tamper evident lid and methods therefor, and particularly to a plastic container having a two-component pull-tab attached to part of the lid at its edge which is used to pull the lid off the container, where the pull-tab has a frangible break line where the act of pulling the pull-tab breaks an outer section away from an inner locked down tab, and once the frangible section is broken, provides evidence that the container was opened, since both parts of the pull-tab are now separated and the outer one bent upwards at an angle.

23 Claims, 6 Drawing Sheets

(56) References Cited

U.S. PATENT DOCUMENTS

| | | | |
|---|---|---|---|
| 8,608,008 | B2 | 12/2013 | Gingras |
| 8,640,914 | B2 | 2/2014 | Meyer |
| 8,672,166 | B2 | 3/2014 | Nazareth |
| 8,684,212 | B2 | 4/2014 | Stone et al. |
| 8,757,416 | B2 | 6/2014 | Golota et al. |
| 8,795,580 | B2 | 8/2014 | Sellari et al. |
| 8,807,385 | B1 | 8/2014 | Fosse |
| 8,939,307 | B2 | 1/2015 | Gingras |
| 8,944,270 | B2 | 2/2015 | Bontrager |
| 9,010,560 | B2 | 4/2015 | Newberry |
| 9,016,503 | B2 | 4/2015 | Barbier |
| 9,102,446 | B2 | 8/2015 | Kowal |
| 9,187,209 | B1 | 11/2015 | Hanna et al. |
| 9,365,331 | B2 | 6/2016 | Gingras et al. |
| 9,409,683 | B2 | 8/2016 | Gingras et al. |
| 9,475,621 | B1 | 10/2016 | Krueger et al. |
| 9,493,277 | B2 | 11/2016 | Parikh |
| 9,527,640 | B2 | 12/2016 | Sellari et al. |
| D776,974 | S | 1/2017 | Kalmanides |
| 2005/0017007 | A1 | 1/2005 | Sellari et al. |
| 2005/0184070 | A1 | 8/2005 | Boback et al. |
| 2007/0045317 | A1 | 3/2007 | Rosender |
| 2008/0087669 | A2 | 4/2008 | Boback |
| 2010/0072217 | A1 | 3/2010 | Parikh et al. |
| 2010/0102074 | A1 | 4/2010 | Parikh et al. |
| 2010/0181323 | A1 | 7/2010 | Thaler |
| 2010/0224630 | A1 | 9/2010 | Petlak |
| 2011/0000929 | A1 | 1/2011 | Brown |
| 2011/0175261 | A1 | 7/2011 | Boback et al. |
| 2012/0005994 | A1 | 1/2012 | Tidball |
| 2012/0048774 | A1 | 3/2012 | Gingras |
| 2012/0103990 | A1 | 5/2012 | McCumber |
| 2012/0181280 | A1 | 7/2012 | Barbier |
| 2013/0020325 | A1 | 1/2013 | Stone |
| 2013/0160406 | A1* | 6/2013 | Johnston ..... B65B 7/26 53/467 |
| 2013/0313275 | A1 | 11/2013 | Gingras |
| 2014/0041343 | A1 | 2/2014 | Corbett |
| 2014/0069922 | A1 | 3/2014 | Boback et al. |
| 2014/0138383 | A1 | 5/2014 | Lisowy |
| 2014/0217100 | A1 | 8/2014 | Nazareth |
| 2014/0284346 | A1 | 9/2014 | McCumber |
| 2014/0300034 | A1 | 10/2014 | Sellari et al. |
| 2014/0367383 | A1 | 12/2014 | Sellari et al. |
| 2015/0008222 | A1 | 1/2015 | Pace |
| 2015/0028033 | A1 | 1/2015 | Samuel |
| 2015/0060456 | A1 | 3/2015 | Vovan |
| 2015/0136777 | A1 | 5/2015 | Baillies |
| 2015/0175315 | A1 | 6/2015 | Parikh et al. |
| 2015/0266611 | A1 | 9/2015 | Kennedy |
| 2015/0367987 | A1* | 12/2015 | Clark ..... B65D 21/0201 220/23.86 |
| 2016/0016707 | A1 | 1/2016 | Sellari |
| 2016/0096663 | A1 | 4/2016 | Lotfi et al. |
| 2017/0001766 | A1 | 1/2017 | Cimmerer et al. |
| 2017/0001767 | A1 | 1/2017 | Cimmerer et al. |
| 2017/0107031 | A1* | 4/2017 | Hsieh ..... B65D 43/14 |

FOREIGN PATENT DOCUMENTS

| | | |
|---|---|---|
| WO | WO2010074759 | 1/2010 |
| WO | WO2014152615 | 12/2014 |
| WO | WO201605297 | 7/2016 |

* cited by examiner

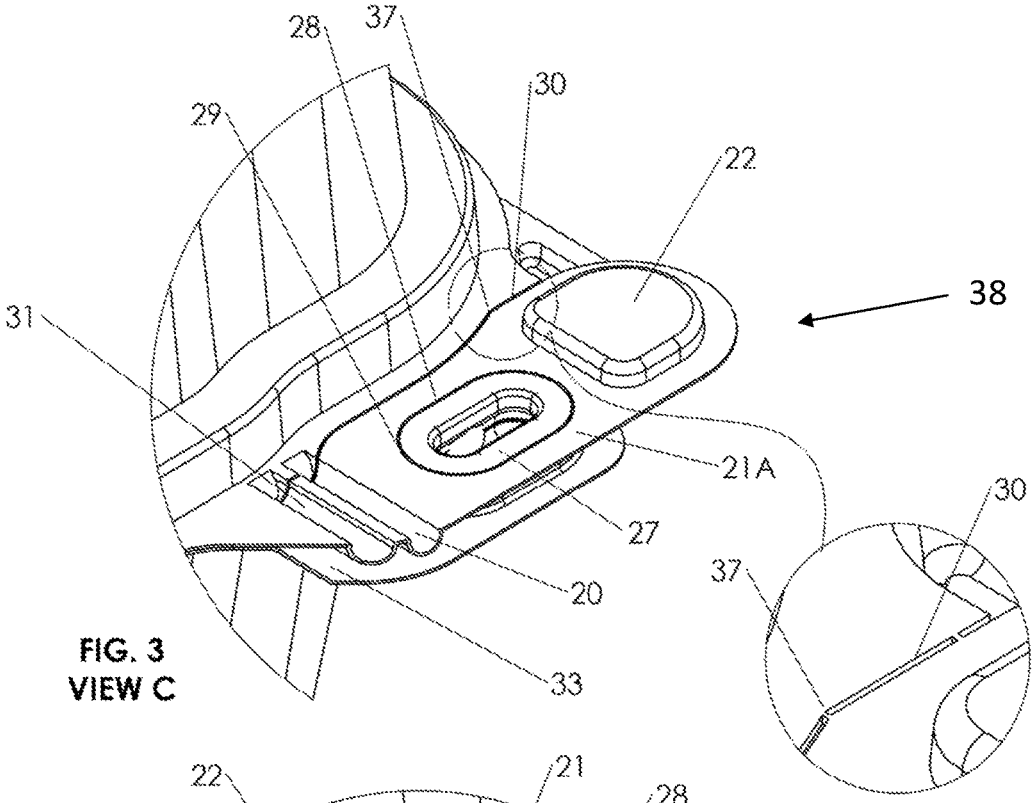
FIG. 3
VIEW C
FIG. 4
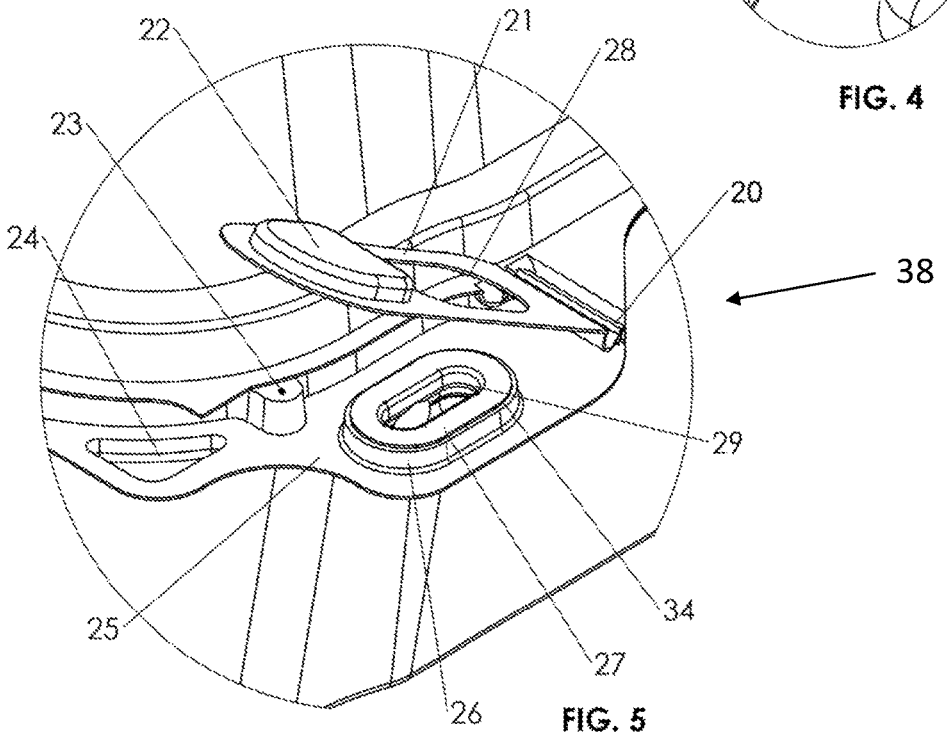
FIG. 5
VIEW B

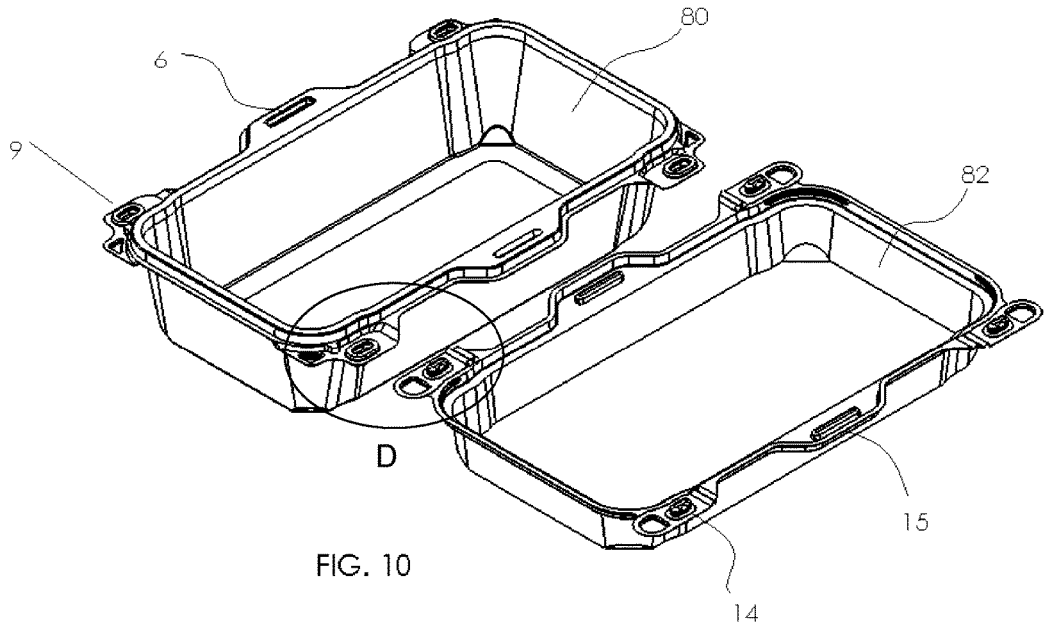
FIG. 10
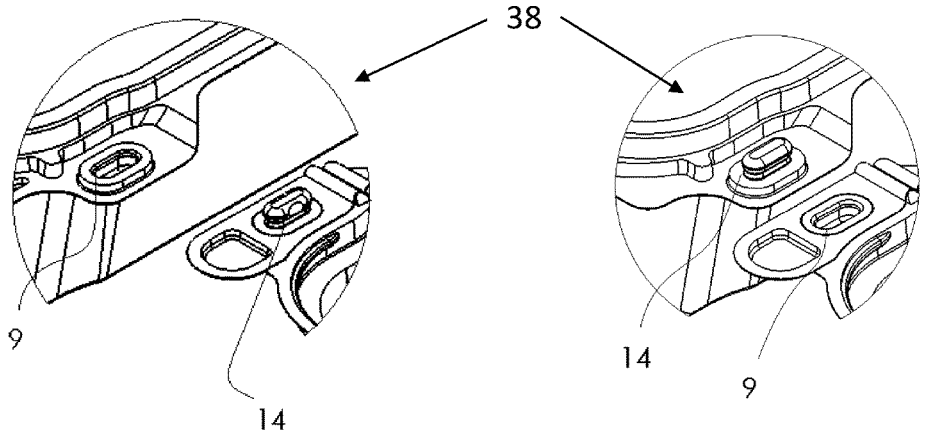
FIG. 11
VIEW D
FIG. 12

VIEW E

PULL-TAB TAMPER EVIDENT CONTAINER

FIELD OF THE INVENTION

The invention relates to a plastic or compostable or biodegradable container having a tamper evident lid and methods therefor, particularly to a container having a two-component pull-tab assembly attached to part of the lid at its edge which is used to pull the lid off the container, where the pull-tab assembly has a frangible break line where the act of pulling the pull-tab breaks an outer section away from an inner locked down tab, and once the frangible section is broken, provides evidence that the container was opened, since both parts of the pull-tab assembly are now separated and the outer one bent upwards at an angle.

BACKGROUND OF THE INVENTION

Balancing the requirements of food safety with the need to provide an attractive presentation has generated a need for tamper proof, tamper resistant, and tamper evident plastic packaging. Tamper evident packaging uses a mechanism in the packaging itself that allows the package to initially be closed in order to contain the food product, but prevents the opening of the packaging without generating some sort of evidence that the container has been opened.

However, many initial efforts generated a number of problems, including consumer usage problems, distribution problems, and manufacturing problems.

Consumer problems include making the packaging too difficult to open for the consumer, generating sharp edges on the opened packaging which can create a hazard, generating removable strips that can accidentally find their way into the food product and adding plastic waste, failing to provide a large enough tamper signal or change for the consumer to notice the package has been tampered with, complicate opening instruction, making the container unable to be re-closed, and failing to allow food containers to be filled on-site at the supermarket with a mechanism that is easily usable by supermarket staff.

Distribution-side problems include making a container that is not stackable, making containers that require separate lids from bases, requiring training in how to use and handling the tamper-resistant packages without damaging the perforated tear-strip while keeping the tamper-evident features intact, and requiring training of grocery or distribution staff to recognize when a product has been tampered with so that it can be removed from the supply chain.

Manufacturing problems include requiring the use of unusual plastics or expensive manufacturing processes, whether to use an injection molding process, a thermoforming process, or some other process in order to create the necessary features for the container. Such features considered by engineers in the field can include how best to accomplish a bent feature, a fold feature, stiffness vs. flexibility, spring-effects, recesses, channels, raised features, structural ribs, tear-able or frangible features, resilient living hinges, pull-tab features, locking features, and sealing tolerances, to name a few.

A wide of variety of technologies and inventions in this field have attempted to address or provide solutions to some of the problems. One example, from 1959, is U.S. Pat. No. 2,915,214 issued to Frankel ad which discloses a plastic container with a lid and a base with "a sealing rim" as a circumferential engagement mechanism. Both the lid and the base have outwardly extending peripheral flanges, connected by a hinge with "rupturable perforations," which, when severed, leave "separated ends" to facilitate opening the container. Another example, from 1978, is German Patent No. 7816353 issued to Menshen which discloses a container with a lid connected to a base by a hinge formed of a projection and a perforated tear strip. Removal of the tear strip allows the container to be opened and provides evidence of possible tampering. This method presented a waste of plastics material that ended up in the wasteland. A further example, from 1996, is U.S. Pat. No. 5,507,406 issued to Urciuoli which discloses a resealable, tamper evident container. It employs a circumferential engagement mechanism, where the base includes a breakpoint "in the form of a perforated line, a groove or the like" connecting the base to the lid. Only by severing the breakpoint can the lid be removed, which provides evidence of possible tampering. This invention had a limitation not be able to reclose and reseal the primary products. Finally, from 2006, is U.S. 7,118,003, which discloses a tamper-resistant/evident container having a tamper evident removable structure that connects the cover to the base portion, a removable tear strip, a secondary engagement mechanism inside the perimeter of the base portion that prevents tampering by sealing the cover to the base. This product is not only added the plastic waste of the tear-strip to the landfield, complicated opening instructions and imposed a hazard to consumers from the shape edges of the perforations after the tear-strip removed. Moreover, the invention adds more complexity for the food processors in handling the delicated containers to prevent breakage/tearing perforations between the lid, tear-strip, and the base.

Therefore, there still remains a need within the field for improved plastic containers having tamper-evident features such as the Pull-Tab Tamper Evident Containers.

BRIEF SUMMARY OF THE INVENTION

Provided herein is a container having a tamper-evident lid. The top rim of the container has a recessed channel that goes around the inside of the rim, and the lid has around it's periphery an outwardly projecting rib that mates with the container channel. The tamper-evident feature comprises a two-component pull-tab attached to part of the lid at its edge which is used to pull the lid off the container. Although both components of the two-component pull-tab assembly stay connected to the edge of the lid, the pull-tab has a round or an oval or a U-shaped frangible break line where the act of pulling the pull-tab breaks the outer section away from the inner tab. Prior to the frangible break, the inner tab is secured to the lid using a button on the underside of the inner tab that fits into a recess on the top of the lid. The outer section is only connected to the inner tab, and the pulling of the outer section against the buttoned inner tab breaks the frangible line. Once the frangible section is broken, this provides evidence that the container was opened since both parts of the pull-tab assembly are now separated, with one section locked into the lower component and the other section bent upwards at an angle.

Another similar container has a base and a lid, which the peripheral lid rim has a raised channel tightly fitted on the peripheral base rim raised channel, and the pull-tab also has a section of the recessed (inverted—larger profile) channel disposed on the top of the lid peripheral rim. The pull-tab connects to the container by a pivotal hinge and to the lid by the locking male-female connection with a round, or an oval, or a U-shape pre-cut breaking line where the act of pulling the pull-tab breaks away the breakable joints from the inner tab. Since the inner tab is no longer connected to the pull-tab, this also provides evidence of tampering.

In one non-limiting preferred aspect, there is provided a tamper evident pull-tab for a container comprising: (a) a pull-tab connected at a first end by a resilient living hinge to an edge of a first part of a two part container, the pull-tab also connected along one side of the pull-tab to the edge of a first part of a two part container by an outer pre-cut channel with breakable joints disposed within the outer pre-cut channel; (b) a pull-tab having an upper surface with a pull-tab grip at a second end and having a pre-cut aperture channel at a mid-section with breakable joints disposed within the pre-cut aperture channel, on a lower surface of the pre-cut aperture channel is configured by a male-female connector having a tensioning element around its circumference; (c) a base-tab connected to an edge of a second part of the two part container and aligned with the pull-tab, the base-tab having a recessed sidewall and an upper wall that forms a locking male-female connection aligned with the pull-tab mating connector, and recessed upper wall is being lower than the support pier caused lifting tension (spring-effects) of the pull-tab when it is engaged; and, (d) a base-tab having recessed sidewalls, a recessed lock upper wall that having an outer circumference larger than the circumference of the pre-cut aperture channel, the base-tab also having a support pier on the upper wall of the base located to be in operative association with the lower wall of the second end of the pull-tab, the support pier having a height above the upper wall of the base-tab greater than the height of the recessed sidewalls, and the base-tab having a finger grip adjacent the support pier; wherein the tension of joining the raised pull-tab with the locking male-female connector is greater than the combined strength of the breakable joints in both the pre-cut aperture channel and the outer pre-cut channel.

In another non-limiting preferred aspect, there is provided a container having a tamper evident pull-tab, comprising: (a) a pull-tab connected at a first end by a resilient living hinge to an edge of a first part of a two part container, the pull-tab also connected along one side of the pull-tab to the edge of a first part of a two part container by an outer pre-cut channel with breakable joints disposed within the outer pre-cut channel; (b) a pull-tab having an upper surface with a pull-tab grip at a second end and having a pre-cut aperture channel at a mid-section with breakable joints disposed within the pre-cut aperture channel, on a lower surface of the pre-cut aperture channel is configured by a male-female connector having a tensioning element around its circumference; and (c) a base-tab connected to an edge of a second part of the two part container and aligned with the pull-tab, the base-tab having a recessed sidewall and recessed lock upper wall that forms a male-female connection with the pull-tab of the first part, the recessed lock upper wall is being lower than the support pier caused lifting tension (spring-effects) of the pull-tab, the sidewalls of the recess having an upper wall with an outer circumference larger than the circumference of the pre-cut aperture channel, the base-tab also having a support pier on the upper surface of the base located to be in operative association with the lower surface of the second end of the pull-tab, the support pier having a height above the upper surface of the base-tab greater than the height of the recessed sidewalls, and the base-tab having a finger grip adjacent the support pier; wherein the first part of the two-part container and the second part of the two-part container are joined along part of the edge by a foldable hinge; and wherein the tension of joining the raised pull-tab forming the male-female connector is greater than the strength of the breakable joint.

In another preferred embodiment, there is provided wherein the container is a hinged container.

In another preferred embodiment, there is provided wherein the container is a two-part, un-hinged container.

In another preferred embodiment, there is provided wherein the first part of the two-part container is a lid of a container.

In another preferred embodiment, there is provided wherein the first part of the two-part container is a base of a container.

In another preferred embodiment, there is provided wherein the first part and the second part of two-part container have sidewalls defining matching, aligned four corners, at least one corner of the first part of the two part container having a first component of a two-part snap-lock mechanism, and at least one corner of the second part of the two part container having a matching second component of a two-part snap-lock mechanism.

In another preferred embodiment, there is provided wherein the resilient living hinge pulls and maintains the pull-tab upwards at an angle "X" larger than 15% when the pull-tab has been separated from a connected pull-tab/base-tab combination.

In another preferred embodiment, there is provided wherein the pull-tab and the base-tab are disposed outside the perimeter of the axial circumference of the container.

In another preferred embodiment, there is provided wherein the pull-tab and the base-tab are disposed inside the perimeter of the axial circumference of the container.

In another preferred embodiment, there is provided wherein the pull-tab and the base-tab are disposed within a recessed area of the container, the recess having walls to prevent accessing the pull-tab laterally.

In another preferred embodiment, there is provided wherein the resilient living hinge is laterally tensioned to prevent re-connecting the pull-tab to the base-tab when the pull-tab and the base-tab have been separated from a connected pull-tab/base-tab combination.

In another preferred embodiment, there is provided wherein the container is produced by the thermoforming process.

In another preferred embodiment, there is provided wherein the pre-cut aperture channel has an open-channel area devoid of the breakable joints, wherein the open-channel area is adjacent the raised pull-tab grip.

In another preferred embodiment, there is provided wherein the breakable joints of the pre-cut aperture channel are in a staggered configuration.

In another preferred embodiment, there is provided wherein the breakable joints of the pre-cut aperture channel are in an off-set staggered configuration wherein only one breakable joint at a time is encountered in the pre-cut aperture channel the pull-tab is actuated.

In another preferred embodiment, there is provided wherein the lid has a raised rim matching with the base rim; wherein the pull-tab has a larger recessed rim channel (mirror-image profile) matching with the upper peripheral rim of the lid in a closed position.

In another preferred embodiment, there is provided wherein the lid has a locking male-female connector on the pull-tab and the upper side of the lid.

In another preferred embodiment, there is provided wherein the lid has a locking male-female connector with and without a pre-cut aperture channel surrounding it.

In another preferred embodiment, there is provided wherein the finger recess is disposed at the end of the pull-tab recess, and on the upper side of the lid for accessibility.

In another preferred embodiment, there is provided a method of making a tamper resistant container, comprising the step of providing a lid for a base, said lid having a two-component pull-tab attached to an edge of the lid, wherein said two-component pull-tab is used to pull the lid off the container, wherein both components of the pull-tab, an outer section and an inner tab, stay connected to the edge of the lid, wherein the outer section and the inner tab of the pull-tab are connected by a frangible break line, wherein the inner tab is secured to the lid using a button on an underside of the inner tab that fits into a recess on a top of the lid, wherein the act of pulling the pull-tab breaks the outer section away from the inner tab, wherein the outer section is only connected to the inner tab, and the pulling of the outer section against the buttoned inner tab breaks the frangible line, and wherein once the frangible section is broken, provides evidence that the container was opened by showing that both parts of the pull-tab assembly are now separated, with the inner tab button-locked into the lid, and wherein the outer section has a tensioned hinge wherein, upon separation from the inner tab, the released outer section is bent upwards at an angle.

In another preferred embodiment, there is provided a method of making a tamper resistant container, comprising the step of providing a lid for a base, wherein the lid has a peripheral lid rim having a raised channel tightly fitted on a peripheral base rim raised channel of the base, wherein the lid has a pull-tab in a recessed channel that disposed on the top of the lid peripheral rim, wherein the pull-tab connects to the base by a pivotal hinge and connects to the lid by a locking male-female connection, said pull-tab having a outer section and an inner tab connected by a pre-cut breaking line having breakable joints, wherein the act of pulling the pull-tab breaks the breakable joints and separates the outer section from the inner tab, and wherein evidence of tampering is provided when the inner tab is no longer connected to the outer section.

BRIEF DESCRIPTION OF THE FIGURES

FIG. 3 is an enlarged sectional view of View C from FIG. 2 showing details of the pull-tab assembly in a semi-closed position.

FIG. 4 is an enlarged sectional view of the breakable/frangible joint and pre-cut channel from FIG. 3 showing details of the pull-tab assembly in a semi-closed position.

FIG. 5 is an enlarged sectional view of View B from FIG. 2 showing details of the pull-tab assembly in an opened, aka tampered, position.

FIG. 10 is a perspective view of an unhinged tamper resistant container is a laid-open position with encircled close up sections D. This is a top perspective view of another preferred embodiment of the invention and shows that the invention contemplates the use of the tamper-evident tab in hinged as well as unhinged containers. FIG. 10 also illustrates that the invention can be used to any size and shaped container, including round, square, rectangular, etc.

FIG. 11 is an enlarged detail view "D" of the pull-tab assembly 38 in an open position and shows the projecting element on an inner tab area and the recessed element on the base. FIG. 11 also illustrates the connection of an outer pull-tab area with the breakable/frangible joint between them; wherein the living hinge connects the pull-tab assembly to the lid while the frangible join connects the pull-tab to the skirt of the lid.

FIG. 12 is an enlarged detail view that shows the opposite of the locking male-female connection of FIG. 11, wherein the projecting element is on the base and the recessed element is on the pull-tab assembly 38 of the lid side.

FIG. 15 also shows the pull-tab assembly in a stowed position at an angle or horizontal position.

FIG. 18 also shows the stacking surface on the lid and the bottom of container (not shown) for multiple stacking.

FIG. 19 also illustrates a fingered recess disposed at the end of the recess and between the protected walls.

DETAILED DESCRIPTION OF THE INVENTION

Figure 1:
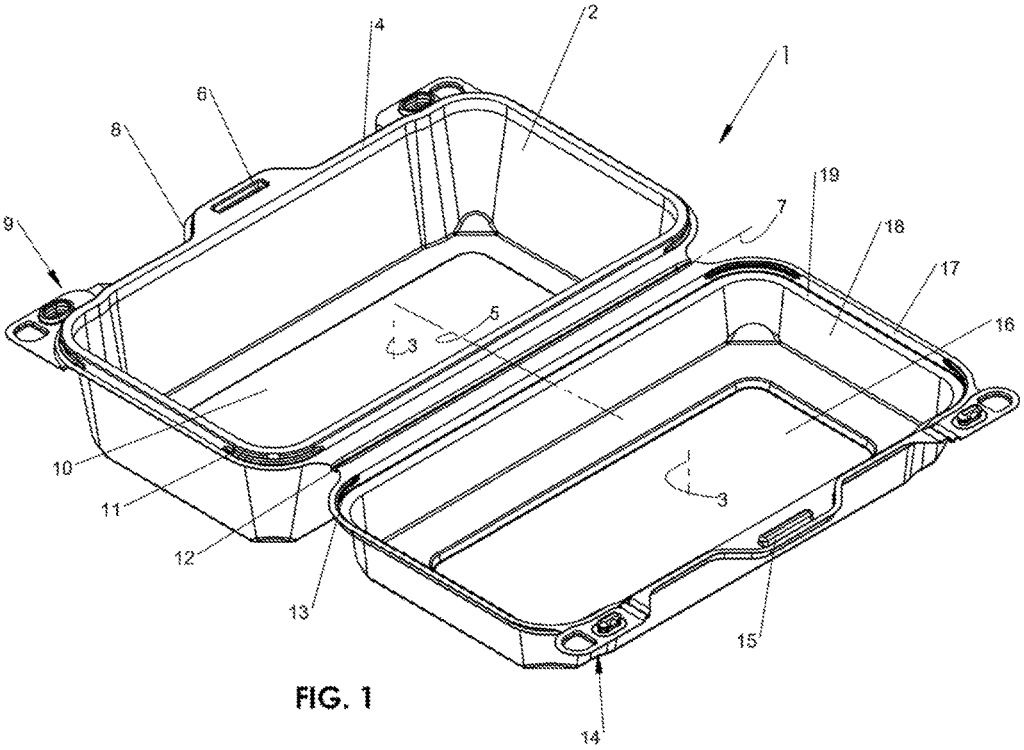
FIG. 1 is a perspective view of a hinged tamper resistant container is a laid-open position.

The advantages of a tamper-resistant/evident container constructed in accordance with the present invention will become more readily apparent to those having ordinary skill in the art from the following detailed description of certain preferred and exemplary embodiments taken in conjunction with the drawings which set forth representative embodiments thereof, but are not intended to limit the scope of the present invention.

Unless otherwise apparent, or stated, directional references, such as "right," "left," "upper," "lower," "outward," "inward," etc., are intended to be relative to the orientation of a particular embodiment of the invention as shown in the first numbered view of that embodiment. In addition, a given reference numeral indicates the same or similar structure when it appears in different figures and like reference numerals identify similar structural elements and/or features of the subject invention.

The term "container" as used in this specification and the appended claims is intended to include any article, receptacle, or vessel utilized for storing, dispensing, packaging, portioning, or shipping various types of products or objects (including, but not limited to, food and beverage products). Specific examples of such containers include, among others, boxes, cups, "clam shells," jars, bottles, plates, bowls, trays, cartons, cases, crates, cereal boxes, frozen food boxes, milk cartons, bags, sacks, carriers for beverage containers, dishes, egg cartons, lids, straws, envelopes, or other types of holders. In addition to integrally formed containers, containment products used in conjunction with containers are also intended to be included within the definition "container". Such articles include, for example, lids, liners, straws, partitions, wrappers, cushioning materials, utensils, and any other product used in packaging, storing, shipping, portioning, serving, or dispensing an object within a container.

It should be readily understood that a container constructed in accordance with the present invention, which is preferably a plastic or compostable or biodegradable container used for carrying edible items, consumer items or pharmaceutical items can be manufactured in a variety of shapes and sizes, and can be formed from resins or plastic materials such as polyethylene ("PE"), polypropylene ("PP"), polyvinyl chloride ("PVC"), polylactic acid ("PLA"), or polyethylene terephthalate ("PETE"), as well as other suitable materials or combinations thereof. The forming process can also vary to include methods such as thermoforming, injection molding, compression or blow molding. The container can be transparent or translucent and may be colored in either instance. Also, vents or steam holes can be provided in the container to promote airflow therethrough, if appropriate based on the intended contents of the container.

Preferably, the container is economically formed by a roll of PETE subjected to a vacuum and pressure mold with plug assist. During manufacture, blades may also be applied to adjust dimensions. Alternatively, a molding tool may be used during the forming step, or a high die forming process can be employed where, after the forming step, the container is indexed to a trim station, where one or more knives liberate the container and creates the pre-cut channels, score lines or perforations. Also, an intermittent cutter can be employed between the forming step or the trim step, a progressive punch and die operation can be employed, or a numerically controlled laser can be employed to create the channels. It is also envisioned that electromechanical, ultrasonic or hydrodynamic systems can be employed in the forming process.

Biodegradable or compostable materials for the containers of the present invention include containers for food, beverage, and medical products made entirely, partially, or as a combination of, cellulosic materials, inorganic aggregates, polysaccharides, starch, vegetable derived polymer materials, natural and synthetic fiber materials, fibers having additional components within a matrix, hydraulically settable materials, microstructural materials, closed-cell and open-cell foam materials, and mixtures and combinations thereof, as well as fillers, cements and binders, thickeners, co-polymers, flow agents, dispersion agents, foaming agents, releasing agents, water-proofing agents, FDA-approved coatings, mixtures and combinations thereof.

Examples of fibers contemplated as within the scope of the invention include fibers which are incorporated into the structural matrix, and especially naturally occurring fibers, such as cellulosic fibers extracted from hemp, cotton, plant leaves, wood or stems, or fibers made from glass, silica, ceramic, or metal. Preferred fibers of choice include glass fibers, abaca, bagasse, wood fibers (both hard wood or soft wood, such as southern pine), and cotton.

It is also contemplated that the containers may include an internal and/or external coating, such as mineral based coatings such as calcium carbonate coating, aluminum or silicon oxides, hydroxypropylmethylcellulose, polyethylene glycol, kaolin clay, acrylics, acrylates, polyurethanes, melamines, polyethylene, polylactic acid, synthetic polymers, and waxes such as beeswax, vegetable or petroleum based wax, and mixtures, and combinations thereof.

Referring now to FIG. 1 is shown a hinged tamper resistant container 1 comprising base 10 connected to base sidewalls 2 which is connected to container hinge 12 for connecting to lid 16 along pivotal axis 7. The invention also contemplates that base 10 and lid 16 is a two-piece construction, without a hinge.

Base sidewall 2 has base upper peripheral wall 4 opposite the bottom wall of base 10. Center recessed lock 6 is located on basic upper peripheral wall 4 at the basic peripheral rim 8. In a preferred embodiment, center recessed lock 6 is opposite container hinge 12. Center recessed lock 6 engages center projection lock 15 on the lid 16. In some embodiments, the lock pairs are offset, off-center or inverse. For example, a locked pair may be located between the center of the corners or near to a corner of the container. In both the hinged embodiment and in the two-piece construction, a single or multiple locks are also contemplated. For example, there may be two lock pairs (a pair includes male-female). In a rectangular container, locks may be along the long side edge or along the short side edge, or both. Similar lock arrangements are contemplated for square and round embodiments, both hinged and unhinged.

Base tamper resistant tab 9 is located along base upper peripheral wall 4 at one of the corners. Corner concave block 11 is located along the basic upper peripheral wall and maybe found at one, two, three or four corners. Corner convex lock 13 mates with corner concave block 11 to provide a locking mechanism.

Upper pull-tab element 14 is found on lid 16 and engages with lower pull-tab element 9. In a preferred embodiment, upper pull-tab element 14 comprises the male locking element with a button projection, and lower pull-tab element 9 comprises the matching female locking element with a cavity for receiving the button projection. In another alternative example (not shown), the male locking element with button projection is part of the base, not the lid, and a female locking element with receiving cavity is part of the lid, not the base. In yet another preferred embodiment, a container with base and lid may have at least one male-female locking element pair in one orientation, and another male-female locking element pair in the opposite orientation, where the first has a projection element on the lid and a receiving cavity element on the base and the second has a receiving cavity element on the lid and a projection element on the base.

In an alternative two-piece non-hinged construction, the matching pull-tab elements (upper-lower) (male-female) can be located on both the outer edge of the container as well as where the hinge would be, in other words, at all four corners, or in some embodiments at transverse or diagonal corners and on any side of the rectangular or square container.

Lid 16 has lid sidewall 18, lid upper peripheral wall 19 and lid skirt 17. Lid 16 is connected to base 10 by way of container hinge 12. Center projection block 15 on lid 16 mates with center recessed block 6 of base 10. Upper pull-tab assembly of 14 comprises a body pull-tab assembly that includes holddown, pull-tab walls, a precut hole, a breakable joint, a front living hinge, a pull-tab grip and a precut channel.

Base sidewall 2 functions as the container sidewalls. The container center axis 3 provides a vertical axis. The base upper peripheral wall 4 for provides an alignment and abuts the ceiling surface 19 of the lid. Container center axis 5 provides a horizontal axis to the container. Center recessed lock 6 provides a snap lock for the container. The hinged container has a pivotal hinge axis 7 aligning the lid and the base. Space peripheral rim 8 aligns with the lid peripheral rim and provides an outer edge to the container.

Lower pull-tab element tab 9 retains the hold down/cavity or female lock and the finger grip/holding tab. Base 10 functions to contain the goods and foods. Corner concave lock 11 functions to hold the lid and the base together. In a hinged embodiment, container hinge 12 provides a pivotal hinge attaching the base to the lid, and in some embodiments providing as sealing mechanism as well. Base 10 has a raised/recessed wall matching with the lid 16 raised/recessed wall to provide a stacking ability for multiple containers.

Corner convex lock 13 works with corner concave block 11 to hold the lid and the base together. The center projection block 15 and the center recessed lock 6 provide a snap lock function for the container when mated. The lid wall 16 provides a protecting cover for the goods or foods in the container. The lid skirt 17 functions to align the base and the lid closure. The lid upper peripheral wall 19 provides an alignment and abuts the ceiling surface of the base peripheral wall 4.

Figure 2:
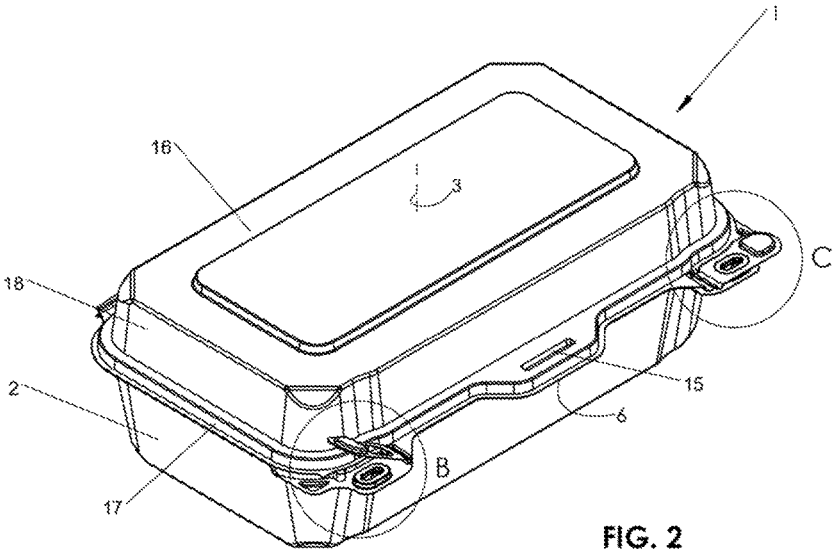
FIG. 2 is a perspective view of a hinged tamper resistant container is a closed position with encircled close up sections B and C.

Referring now to FIG. 2, lid 16 is shown connected to lid sidewall 18. FIG. 2 shows the lid having the upper/male projection element, and the base having the lower/female cavity element. Although as stated, this can be reversed where upper and lower orientations are switched, and in some embodiments, where there is one pull-tab assembly having a lid projection element and base cavity element, and another pull-tab assembly having a lid cavity element and a base projection element. The pull-tab assembly shown at B and C and the center projection lock and the center recessed lock 15 and 6 are shown providing a snap lock to the closed container. B shows an opened pull-tab assembly, and C shows a mated, closed (tamper resistant feature) pull-tab assembly. Lid skirt 17 is shown adjacent to base sidewall 2 and extends around the peripheral of the container 1 to prevent accessibility without opening it from the pull-tab.

Referring now to FIG. 3, FIG. 3 is an enlargement of View C from FIG. 2 showing details of the pull-tab assembly in a semi-closed position. Upper pull-tab element 14 is shown in detail and comprises pull-tab grip 22, connected to pull-tab holddown/projection element 27, and hinged abutment 31. Precut perforated channel 30 connects pull-tab 21 to lid skirt 17. In one embodiment, this channel is a weakened tearable channel 30. In another preferred embodiment, this channel is a perforated cut having breakable attachment points/breakable joints 37. These breakable attachment points/joints may be equally spaced, or they may be staggered. The staggering of the breakable attachment points/ joints can allow a larger separation at specific sections along the channel, and thus easier/lower tear-force compared to sections having closer separations. In one embodiment, larger separations at the initial tear location can allow for a lower force at the start and a momentum-building, with increasingly closer tear-separations in a middle section, and then larger separations at the foldable hinge to allow easier breakage/separation in a structurally sensitive section. In one embodiment, a closer gap between the breakable joints is intentionally located close to the projection element and recess element connection to provide the rigidity for closing/locking of the connection.

FIG. 3 shows very important details of the invention relating to the feature whereby once the tamper-evident lock is actuated by pushing the projection button into the locking cavity, the act of opening the container requires the pull-tab assembly to be partially torn from the lid (up to the hinge), and the pull-tab assembly itself to be permanently deformed and permanently, partially dismantled or disassembled whereby the male projection of the upper tab element is similarly torn away and left locked in the locking cavity after the inner channel 28 is torn during the pulling of the upper tab element 14 from the lower tab element 9.

Regarding the inner tear channel of the pull-tab assembly 38, precut channel 28 has a plurality of breakable (frangible) joints 29 disposed within the channel. Channel 28 defines pull-tab holddown/projection 27 from upper pull-tab surface 21A. However, it is important to note that the tearing action to break/separate channel 28 requires the channel to have staggered, offset breakable joints 29 to avoid pulling the projection out of the cavity and thus destroying one of the tamper-evident features of the invention. In a preferred embodiment, there a no breakable joint 29 in channel 28 at the area closest to pull-tab grip 22. Having a weakened, open channel at the area where initial separation is made, avoids pulling the upper tab assembly with such force so as to mistakenly cause the male projection to be removed from the cavity. In one non-limiting preferred embodiment, it is contemplated that the first breakable joint in channel 28 is not encountered until approximately of 30 degrees along the arc of the channel 28, as measured from a bisecting line drawn from the center of pull-tab grip 22 to the center of hinge 20. In another preferred embodiment, the first breakable joint is first encountered ranging from 20-40 degrees along the arc. In yet another preferred embodiment, the first breakable joint is first encountered ranging from 15-60 degrees along the arc of the channel.

In addition to having a momentum-space in channel 28 free from connecting joints 29, another feature is that the breakable connecting joints 29 are required to be staggered so that the tearing action of pulling the upper tab element 14 from lower tab element 9 encounters only a single breakable joint at a time. This minimizes the upward displacement force on the male projection while it is locked within the locking cavity of the lower tab element. Staggering these breakable attachment points/joints provide control over the upwards displacement force on the projection and maintain an easier/lower tear-force. In another preferred embodiment, the distances of the staggering are varied along the breakline in order to provide specific ratios of connecting force to displacement force along specific sections of the channel. In one embodiment, larger separations at the initial tear location can allow for a lower force at the start and a momentum-building, with increasingly closer tear-separations in a middle section, and then larger separations again at the end of the channel nearest the foldable hinge to allow easier breakage/separation in a structurally sensitive section. In yet another embodiment, staggered, equidistant joints can provide a smooth pulling action and reduce any jarring displacement forces on the projection.

In another preferred embodiment, the pull-tab assembly 38 includes a lower pull-tab element 9, an upper pull-tab element 14, a pull-tab holddown 27 and a locking pair of mechanism of male projection 35 and female/cavity 36; whereas the pull-tab assembly 38 is located outside of the container, between or at the center of the corners, or at adjacent to a corner of the container. The locking pair herein represents of the locking male-female connector.

Relating to the living hinge 20, the resilient living hinge 20 is another important tamper-evident feature of the invention. The living hinge 20 is located on the upper pull-tab element opposite the grip 22. In a locked pull-tab assembly 38 (closed, tamper-resistant, triggers are set), when the upper pull-tab element is peeled/pulled away from the lower tab element, leaving the projection locked in the cavity, the upper pull-tab element ultimately reaches the point where the tearing/opening process becomes very difficult, when the channel 30 has been separated, the double-foldable hinge 20, 31 is un-sprung from where it has been seated. Using a double-foldable hinge that is spring-set into a matched hinge seat, allows the upper pull-tab element to pivot upward once it is released, and resilient pivotal hinge 20 maintains the pull-tab in an upward position. By using a double-foldable hinge, any attempt to re-close the container and defeat the tamper-evident features will cause the upper tab element to lengthen, remain unseated, and remain at a deformed angle, thus providing evidence of tampering.

FIG. 4 is an enlarged view of the breakable/frangible joint 37 and pre-cut channel 30 from FIG. 3 showing details of where the pull-tab assembly is attached to the lid/skirt 8.

Referring now to FIG. 5, yet another tamper evident feature is provided. FIG. 5 is an enlarged view B from FIG. 2 showing details of the pull-tab assembly in an opened, aka tampered, position. View B shows the pull-tab assembly in an open position with the projection having been torn from the upper tab element and remaining locked in the lower tab element's cavity. The opening process shown in FIG. 5 illustrates how pulling on pull-tab grip 22 separates pull-tab upper wall 21 from pull-tab holddown 27. Recessed lock sidewalls 26 and recessed block upper wall 34 provide additional tampering evidence. As discussed, resilient living hinge 20 urges the unconnected upper tab element 21 forward after separation and provides resistance to reconnection. Support post/pier 23 and the peripheral upper wall 34 is larger than the pre-cut peripheral inner channel 28, which prevents reattachment when the precut channel 30 has been severed, as will be explained below. Base finger grip 24 is shown and is used to hold the base while pull-tab grip 22 is pulled.

Support post/pier 23, importantly, is not at the same relative height as the surface of upper tab element 21 when it is in its locked-down position. This is elaborated in the following drawings, but also note that the perimeter of the male projection/holddown 27 (as well as the perimeter of channel 28 from whence it was removed) is smaller than the shelf perimeter of the entrance sidewalls of the female cavity, also called recessed lock upper wall 34. As will be seen, the height differential between the support post 23 and the holddown 27, provides another aspect of spring-loaded effect in the locked position, that is permanently separated or deformed when the pull-tab assembly 38 is clearly sprung upward and maintains in an upward position. This is an important visual indication of tampering.

FIG. 5 also shows recessed lock sidewalls 26 as the raised portion of the female cavity element from the base recessed wall 25 of the base. As yet another tamper-resistant feature, sidewalls 26 are sloped to be wider at the base than at the top. Therefore, any attempt to replace the torn pull-tab assembly by pushing the opening in the upper tab element created by channel 28 back onto the lower female cavity-projection structure will not succeed because, first, the circumference of the opening cause by channel 28 is not larger enough to accommodate the cavity-projection structure, and secondly, if the plastic of the upper tab element is forced down onto the cavity-projection structure, the sloped walls, wider at the bottom, will cause the upper tab element to pop-up and be displaced off the cavity-projection structure. Additionally, Support 23 provides a higher/raised, off-center support under the upper pull-tab and prevents the pull-tab from naturally pivoting below the holddown 27 or upper wall 34 of the lower cavity/recess without being visually bent at an angle. The base recessed wall 25 creates an opening gap for grabbing the pull-tab.

Figure 6:
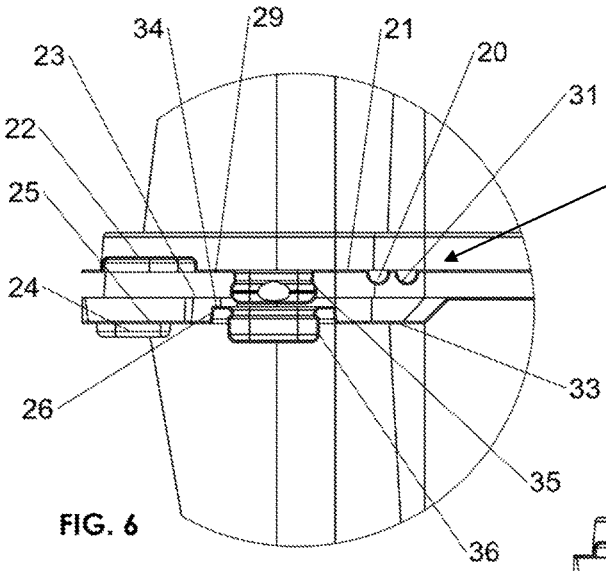
FIG. 6 is an elevation view of the pull-tab in cross section prior to the projection lock being snapped into the recess.

Referring now to FIG. 6, FIG. 6 is an elevation view of the pull-tab assembly 38 in cross section prior to the projection lock being snapped into the cavity/recess. FIG. 6 shows the lower tab element having lower recessed lock 36 connected to the recessed wall 33 of the base. The recessed cavity lock sidewalls 26 of the female cavity element and the upper wall 34 of the recessed lock are shown on an outer portion the lower tab element 9. Base finger grip 24 can be recessed, raised or textured for a positive gripping, and it is adjacent to the basic peripheral rim 8. It is also shown as and an optional feature to aid in grasping the base during closing or opening. The base recessed wall 25 is lower than the recessed lock upper wall 34 and surrounds by the inclined vertical wall 26.

FIG. 6 also shows upper tab element 14 having a resilient living hinge 20 and hinge abutment 31 for supporting the hinge. The upper pull-tab element also has surface 21, male projection (lock) 35, upper tab grip 22, a pre-cut channel 29 are connected with the pull-tab surface 21. FIG. 6 also shows support post/pier 23 having the upper surface against the lid peripheral rim 32 when the container is closed.

Figure 7:
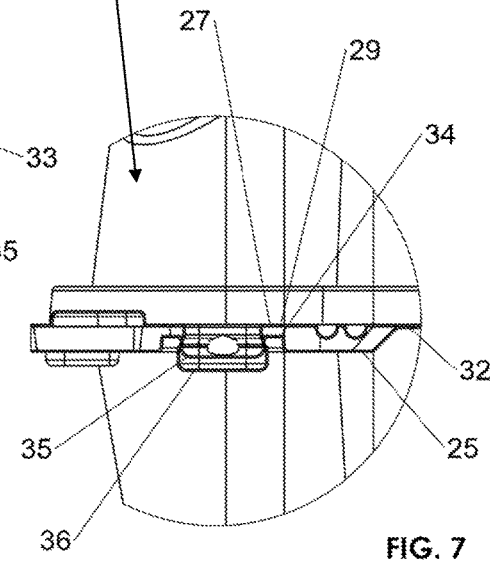
FIG. 7 is an elevation view of the pull-tab in cross section as the projection lock is at a midpoint of being snapped into the recess.

Referring now to FIG. 7, FIG. 7 is an elevation view of the pull-tab in cross section as the projection lock is at a midpoint of being snapped into the recess and shows upper pull-tab assembly is shown in a partially engaged position with the lower cavity element. Male upper projection lock 35 is shown in the process of being engaged with female lower recessed lock 36 in the locked position. Pull-tab holddown 27 and breakable joint 29 between the precut channel are shown adjacent to the recessed lock upper wall 34.

Figure 8:
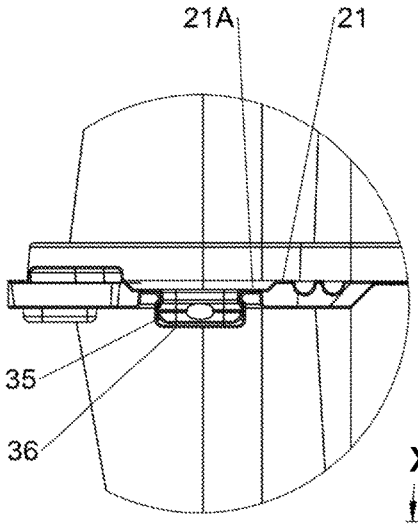
FIG. 8 is an elevation view of the pull-tab in cross section after the projection lock has been snapped into the recess wherein the pull-tab surface flexes downward in engaging.

Referring now to FIG. 8, FIG. 8 is an elevation view of the pull-tab in cross section after the projection lock has been snapped into the recess, and shows upper pull-tab assembly fully engaged in a locked position. Male upper projection lock 35 is fully locked into female lower recessed lock 36. However, the most important aspect of this drawing is that it shows show the upper tab element surface 21 is bent down and deformed to parallel the surface of the lower tab element at 21A. Similarly, on the other side of the projection-cavity combination, FIG. 8 illustrates how the surface of the upper tab element is bent down and deformed onto the surface of the lower tab element, and especially, is deformed on top of and around the support post/pier 23, see in FIG. 6. These deformations are only possible because the projection is being held down into the locking cavity. Once the male projection is torn from the upper tab element (and remains seated in the locking cavity), there are no forces to counter the natural, spring effect from the plastic of the container to maintain the deformed position. These deformations are permanently undone when the upper and lower tab elements are separated, and the lack of a "tight fit", an offset position of the upper tab element, provides visual evidence of tampering.

Figure 9:
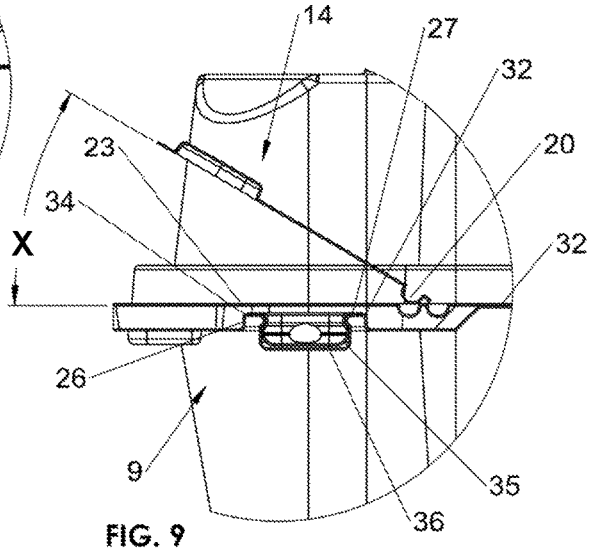
FIG. 9 is an elevation view of the pull-tab in cross section of the projection lock being snapped into the recess; wherein the pull-tab is being pulled upward and pivoted at an angle "X" while the inner tab is being attached to the female lock.

Referring now to FIG. 9, FIG. 9 is an elevation view of the pull-tab in cross section prior to the projection lock being snapped in to the recess and is an illustration of how the upper pull-tab element 14 looks after the tamper evident feature(s) have been activated. In FIG. 9, the pull-tab grip 22 has been pulled and has separated the breakable joints along both of the precut channels, the channel between the lid and the upper tab element, and the inner, (elliptical) channel around the male projection holddown. This leaves the male upper projection lock 35 remaining in the female lower recessed lock 36 and leaves an opening in pull-tab 21. Lid peripheral rim 32 is shown adjacent to front resilient living hinge 20. Pull-tab holddown 27 is shown adjacent to lid peripheral rim 32, and support 23 is shown adjacent to recessed lock upper wall 34.

In one preferred embodiment, recessed lock sidewalls 26 are larger in diameter than the opening left in the outer pull-tab (channel 28) when pull-tab grip 22 is pulled, and the precut channel and the breakable joints are separated. This size differential prevents the tab from being relocked down by a simple push downward. The tension of the sidewalls, wherein the circumference of the sidewall is wider at the bottom than at the top, helps to pop-up, or displace, the upper pull-tab element, and provide evidence of tampering. And, as previously stated, the double-foldable hinge 20 provides another tamper-resistant/tamper-evident feature. And, support post 23 can be seen here as taller than the surface of the cavity-projection/holddown 27.

FIG. 10 shows an unhinged container having a base 80 and a lid 82, including a locking pairs with a center recessed lock 6 of the base is engageable to a center projection lock 15 on the lid. In some instances, the locking pairs are located offset, off-center or inverse position. These locking pair may be along the side edge of the square or rectangular or round container with both hinged and unhinged.

FIG. 11 shows an enlargement of view "D" of the lower pull-tab element 9 having a lower recessed lock 36 on the base, and the upper pull-tab element 14 having a projection lock 35 on the lid on an unhinged container. The pull-tab assembly is also shown near to the corner of the container. In another instance, the pull-tab assembly can be located at the center or along the side edge of the container.

FIG. 12 shows an enlargement of the pull-tab assembly wherein the recessed lock 36 and the projection lock 35 in a reserved position. In another instance, the pull-tab assembly may have the (upper) pull-tab element 14 on the base, and the (lower) pull-tab element 9 on the lid; wherein the pull-tab shall be pulled downward before opening/separating the lid and the base. Therefore, the combination of locking figures is defined as a locking male-female connector.

Figure 13:
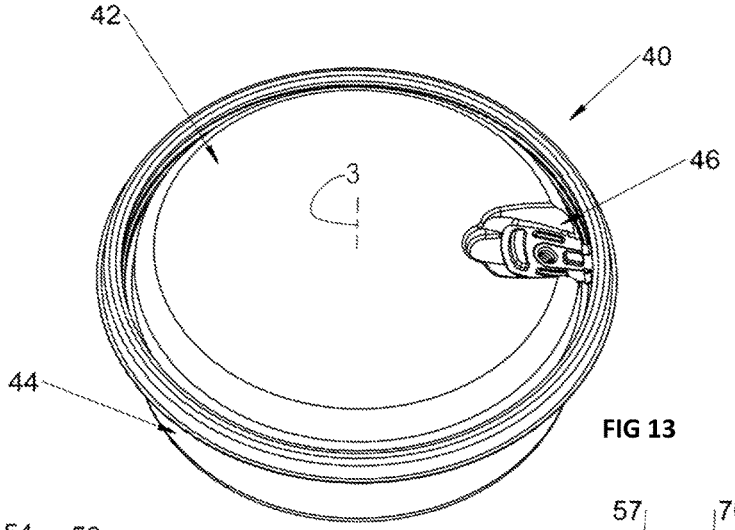
FIG. 13 is a perspective view of an unhinged (hinged not shown) round or oval shape of the tamper resistant container in a closed position; wherein the pull-tab assembly is disposed on the lid at a horizontal or inclined position; wherein the lid skirt is concealed by the base rim to deter of tampering.

Referring now to FIG. 13, FIG. 13 is a top perspective view of another preferred embodiment of the invention and shows that the invention contemplates the use of the tamper-evident tab in hinged as well as unhinged containers. FIG. 13 also illustrates that the invention can be used on any shaped container, including round, square, rectangular, etc. Round tamper resistant package 40 is here comprised of a two-piece container. The two-piece container comprises a lid 42, which (lid) is in this case, that engages with a round container 44. The lid peripheral-rim is concealed by the base peripheral-rim, which is one of many features that functions to prevent tampering. FIGS. 14-17 illustrate pull-tab assembly 46, which is shown for accessibility of the container contents, but is without lid and base peripheral rims.

Figure 14:
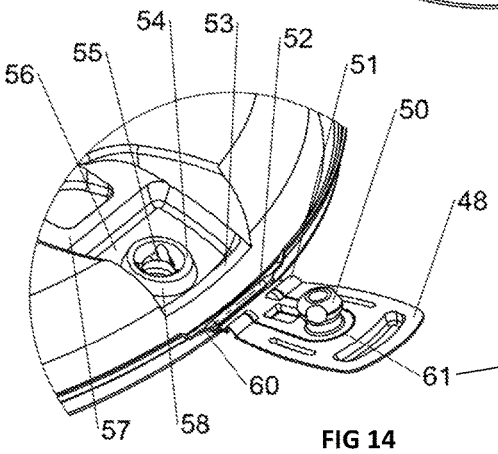
FIG. 14 is an enlarged detail view of the pull-tab assembly 38 in an open position, and shows the projecting element on an inner tab area connecting to an outer pull-tab area with a breakable/frangible joint between them, the living hinge is connecting between the pull-tab to the lid, and the recess for receiving the projection within a protected, walled area.

Referring now to FIG. 14, this illustrates the pull-tab assembly in an open position. FIG. 14 also shows the locking recess/cavity 55 as part of the lid, and a locking projection 50 attached to the lid pull-tab assembly. The locking projection 50 has an inner tab area 70 connecting to an outer pull-tab area 48 with a breakable/frangible joint 65 between them, the resilient living hinge 52 connecting to the lid 42, and the recess/cavity lock 55 for receiving the projection 50 within a protected, walled area 67. Male concave locking projection 50 is shown attached to the pull-tab upper wall 48 and the pull-tab 45. Pull-tab 45 connects to the front living hinge 51 which is attached along with the living hinge axis 60 to the edge of the lid. Female convex locking recess 55 is disposed within recess wall 56 and connects to recessed lock sidewall 58 with recessed lock upper wall 54. Recess wall 56 also connects the peripheral walls with upper rear pier 53 and front pier 57. Upper rear pier 53 and/or upper front pier 57 is taller/higher than recessed lock upper wall 54, which creates a downward deflection/tension (spring-effects) of the pull-tab assembly in an engaged/locked position (important tamper-evident feature). After pull-tab 45 is being pulled/lifted upward and separated from holddown 70 (details in FIG. 12), the pull-tab is naturally sprung upward to a neutral position (stress-free), which the pull-tab lower surface 48 is clearly separating from the surface holddown 70 whence its initial locking position (shown at a different height from front pier 57).

Importantly in FIG. 14, feature 54, the recessed lock pier upper wall 54 of the male-female connector, has a larger outer circumference than precut channel 61, that does not permit the aperture created by the removing of the male projection of the tab from fitting over the top of it as an important tamper-evident feature of the invention.

Figure 15:
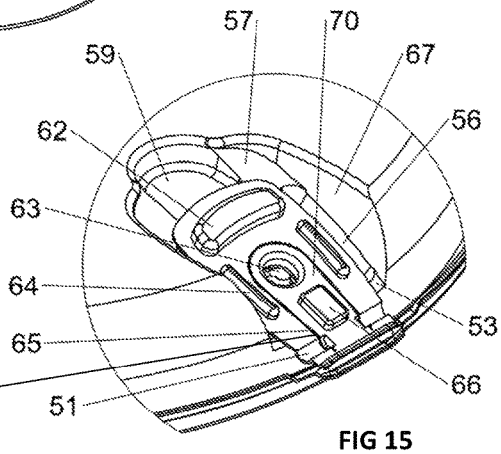
FIG. 15 is an enlarged detail view of the pull-tab assembly in a closed/locked position, and shows the projecting element on an inner tab area connecting to an outer pull-tab area with a breakable/frangible joint between them, the living hinge is connecting between the pull-tab assembly to the lid, and the recess (not shown) for receiving the projection within a protected, walled area.

Referring now to FIG. 15, FIG. 15 illustrates the pull-tab in a closed/locked position, and shows the projecting element on an inner tab area connecting to an outer pull-tab area with a breakable/frangible joint between them, the resilient living hinge connecting to the container, and the recess element (hidden under pull-tab assembly) for receiving the projection within a protected, walled area. Front living hinge 51 is adjacent to breakable joint 65 along precut channel 61. Pull-tab grip 62 is a raised/recessed/textured grip and is attached to pull-tab 45. Pull-tab 45 has riser rib 64 providing rigidity and raised rib 66 to increase stiffness and aid raising the pull-tab above the pulldown remaining laid flat on the lid while the pull-tab raised above after the breakable joint has been separated. Finger recess 59 is shown at a different height than upper front pier 57. This is important because when the tab is snapped into the cavity, it causes the plastic to deform, e.g. at 45. However, once the pull-tab is pulled, the projection is removed from the pull-tab and remains locked in the recess/cavity, the tab cannot be replaced in the same deformed position. This is one tamper-evident feature of the present invention.

The mechanical (male-female) connector 63 is also shown as part of pull-tab holddown 70, including locking projection and recess/cavity lock with a tensioning element around its circumference. Cavity protective sidewall 67 also prevents tampering with the pull-tab by preventing from accessing the locked-down projection, and disengaging it from the locking cavity without tearing the breakable channel.

Living hinge 51 also provides a tamper evident feature by lengthening the tab, creating space under a loosened tab, and by holding the tab up at an angle, all to provide a visual cue to tampering.

As described previously, channel 61 in tab assembly 46 has a plurality of breakable (frangible) joints 65 disposed within the channel. Channel 61 defines pull-tab holddown/projection 60 of the locking male-female connection from upper pull-tab surface 45. However, it is important to note that the tearing action to break/separate channel 61 requires the channel to have staggered, offset breakable joints 65 to avoid pulling the projection 50 out of the female convex recessed lock (cavity) 55 and thus destroying one of the tamper-evident features of the invention by having the pulling force to exceed the retention force between the interference fit of the locking male-female connection. In a preferred embodiment, there a no breakable joint 65 in channel 61 at the area closest to pull-tab grip 62. Having a weakened, open channel at the area where initial separation is made, avoids pulling the upper tab assembly with such high force so as to mistakenly cause the male projection to be removed from the cavity. In one non-limiting preferred embodiment, it is contemplated that the first breakable joint in channel 61 is not encountered until approximately 30 degrees along the arc of the channel 61, as measured from a bisecting line drawn from the center of pull-tab grip 62 to the center of hinge 51. In another preferred embodiment, the first breakable joint is first encountered ranging from 20-40 degrees along the arc. In yet another preferred embodiment, the first breakable joint is first encountered ranging from 15-60 degrees along the arc of the channel.

In addition to having a momentum-space in channel 61 free from connecting joints 65, another feature is that the breakable connecting joints 65 are required to be staggered so that the tearing action of pulling the upper tab element from lower tab element encounters only a single breakable joint at a time. This minimizes the upward displacement force is lower than the retention force on the male projection while it is locked within the locking cavity of the lower tab element. Staggering these breakable attachment joints provides control over the upwards displacement force on the projection and maintains an easier/lower tear-force. In another preferred embodiment, the distances of the staggering are varied along the break-line in order to provide specific ratios of connecting force to displacement force along specific sections of the channel. In one embodiment, larger separations at the initial tear location can allow for a lower force at the start and a momentum-building, with increasingly closer tear-separations in a middle section, and then larger separations again at the end of the channel nearest the foldable hinge to allow easier breakage/separation in a structurally sensitive section. In yet another embodiment, staggered, equi-distant joints can provide a smooth pulling action and reduce any jarring displacement forces on the projection.

Figure 16:
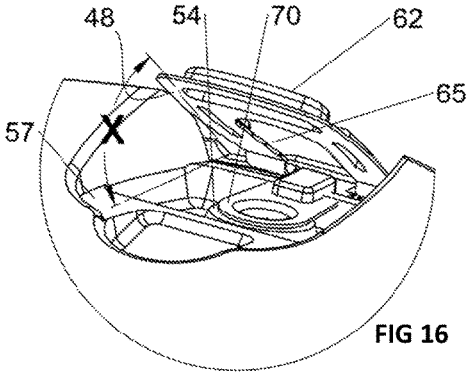
FIG. 16 is an enlarged detail view from a point above the container and inside the perimeter of the container, of the pull-tab in a post-opening position, and shows the projecting element on an inner tab area broke away from the outer pull-tab, the projection still locked into the recess, which the inner tab area is smaller than upper surface of the recess area and the outer pull-tab area connected to the lid by a living hinge which causes the outer portion to remain in a raised position at an angle "X" of several degrees.

Referring now to FIG. 16, FIG. 16 illustrates from a viewpoint above the container and inside the perimeter of the container, the pull-tab in a post-opening position, and shows the projecting element 50 on an inner tab area broken away from the outer pull-tab, the projection 50 still locked into the recess 55, and the outer pull-tab area connected to the container by a resilient living hinge 52 which causes the outer portion to remain in a raised position. Pull-tab bottom wall 48 has been removed away from front pier area 57. Breakable joint 65 has been torn creating an opening and leaving the pull-tab holddown 70 locked in place, while pull-tab grip 62 is raised, and pull-tab 45 is pulled away from the lid.

Importantly, FIG. 16 also shows the perimeter of the male projection/holddown 70 (as well as the perimeter of channel 61 from whence it was removed) is smaller than the shelf perimeter of the entrance sidewalls of the female cavity, also called recessed lock upper wall 54. As will be seen, the height differential between the support post 57 and the holddown 70, provides another spring-loaded aspect in the locked position, that is permanently deformed when the tab assembly is separated.

FIG. 16 also shows recessed sidewalls 58 next to the upper wall 54 as the raised portion of the female cavity element. As yet another tamper-resistant feature, sidewalls are sloped to be wider at the base than at the top. Therefore, any attempt to replace the torn pull-tab assembly by pushing the opening in the upper tab element created by channel 61 back onto the lower female cavity-projection structure will not succeed because, first, the circumference of the opening causes by channel 61 is not larger enough to accommodate the cavity-projection structure, and secondly, if the plastic of the upper tab element is forced down onto the cavity-projection structure, the sloped walls, wider at the bottom, will cause the upper tab element to pop-up and be displaced off the cavity-projection structure. Additionally, Support of front pier 57 provides a raised, off-center support under the upper pull-tab wall 48 and prevents the pull-tab from naturally pivoting below the holddown 70 or reconnecting without being visually bent at an angle.

Figure 17:
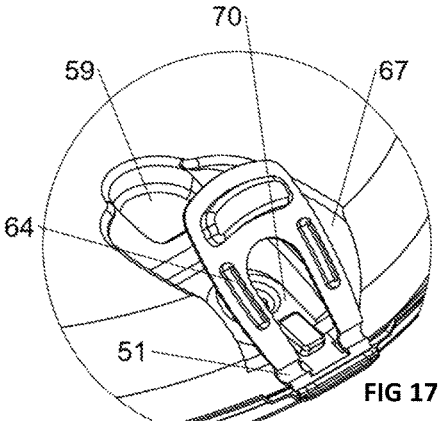
FIG. 17 is an enlarged detail view from a point above the container and outside the perimeter of the container and shows the pull-tab in a post-opening position, with the projecting element on an inner tab area broken away from the outer pull-tab, the projection still locked into the recess, and the outer pull-tab area connected to the lid by a living hinge which causes the outer portion to remain in a raised position.

Referring now to FIG. 17, FIG. 17 illustrates from a viewpoint above the container and outside the perimeter of the container, and shows the pull-tab assembly 46 in a post-opening position, with the projecting element 50 on an inner tab area 70 broken away from the outer pull-tab 45, the projection 50 still locked into the recess 55, and the outer pull-tab area connected to the container by a resilient living hinge which causes the outer portion to remain in a raised position. Front living hinge 51 is shown in a bent position when pull-tab 45 has been raised. Riser rib 64 provides structural support to pull-tab 45 and prevents tampering. Cavity sidewall 67 prevents tampering from the side. Pull-tab grip 62 is shown exposed. The precut channel 61 is smaller than the upper wall of the recessed wall 54 which prevents a through slot of the pull-tab protruding below the recessed lock upper wall. Cavity sidewall 67, in addition to protecting the pull-tab assembly from damage from the side, also functions to assist and multiple containers stacking.

Figure 18:
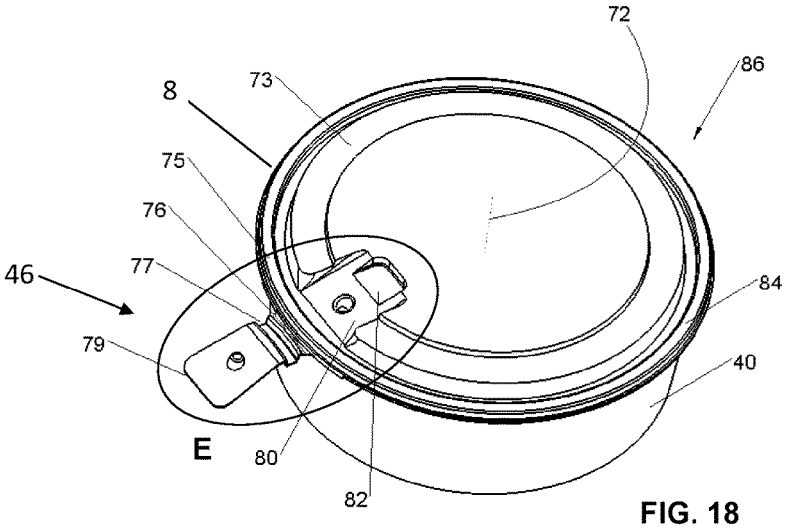
FIG. 18 is a perspective view of an unhinged (hinged not shown) round or an oval tamper resistant container (base and lid) in a closed position, wherein the lid rim closely fits on the base rim and the pull-tab is in an opened position connecting to the lid skirt by a foldable hinge with encircled close up sections E.

Referring now to FIG. 18, FIG. 18 illustrates a container is a top perspective view of another preferred embodiment of the invention and shows that the invention contemplates the use of the tamper-evident tab in hinged as well as unhinged containers. FIG. 18 also illustrates that the invention can be used on any shaped container, including round, square, rectangular, etc. Round tamper resistant package 86 is comprised of a two-piece container having an axis 72 that is surrounding by a stacking surface 73 and an upper peripheral rim 75. The two-piece container comprises a round lid 84 that engages with a round base 40. The lid peripheral rim is covered and sealed the base peripheral rim 75 preventing of tampering, and sealing preventing of leakage. Pull-tab assembly 46 is shown for the accessibility of the container contents.

FIG. 18 also illustrates the pull-tab assembly in an opened position (in encircled with a closeup section E) whereas the pull-tab element is attached to the lid peripheral edge by a foldable/pivotal hinge 76, which the width of the hinge is not greater than the pull-tab, and adjacent to a recessed peripheral rim channel 77 and connecting to the pull-tab 79. Recessed peripheral rim channel has a mirror-image (inverted) profile matching with the raised peripheral rim of the lid. Pull-tab recess 80 and finger recess 82 are disposed between the protective wall 83 of the lid.

Referring to FIG. 18, In another preferred embodiment in FIG. 18, a pull-tab 79 and a recessed peripheral rim channel 77 are being formed and connected to the base peripheral rim 8 by a foldable hinge 76. (the important feature of the invention detailed in FIG. 21)

Figure 19:
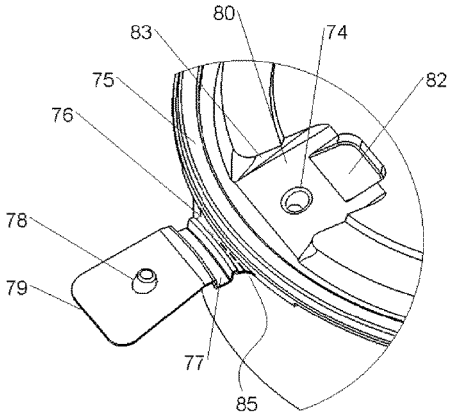
FIG. 19 is an enlarged detail view of section E wherein the pull-tab in an opened position and shows the projecting element on the pull-tab and the recess on the lid. It shows the pull-tab having an inverted matching channel that fits on the rim of the lid, and connects by a foldable or perforated hinge.

Referring now to FIG. 19, FIG. 19 is an enlarged view of section E of the pull-tab assembly 46 in an opened position. Pull-tab 79 and recessed peripheral rim channel 77 are also connected to the peripheral rim by a pivotal hinge 76 at an axis 85, which recessed rim channel has a larger mirror-image profile of the peripheral rim 75 and fits over the peripheral rim of the lid when it is engaged. Projection element 78 on the pull-tab and recess/cavity element 74 on the pull-tab recess, or vice versa, are aligned and engaged in a stowed position at the point of sales.

Figure 20:
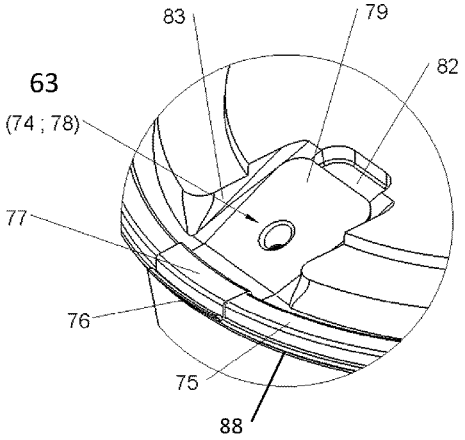
FIG. 20 is an enlarged detail view of the pull-tab assembly with a locking male-female connection, which is disposed on the lid at an inclined or horizontal position; wherein the inverted matching channel fits closely on the lid rim while the lid pull-tab is protected by the protected walls.

Referring to FIG. 20, FIG. 20 illustrates that the pull-tab assembly 46 is connected to the lid peripheral rim and in a stowed position, which the pull-tab is pivoted/folded and laid against the pull-tab recess and protected from tempering by protective wall 83. Locking (male-female) connection 63 is disposed on the pull-tab assembly 46 and spaced from the finger recess 82. This is an opening access to the pull-tab 79 by pulling/lifting it upwardly. The lower wall of the recessed rim channel 77 is matched and fitted over the lid peripheral rim, and adjacent to the foldable/pivotal hinge 76. The important feature of this invention is the pull-tab assembly 46 attached to the lid, which does not need to be in a certain orientation matching with the base in a closed position of the container, and which functions in non-limiting embodiments, including, round, square, rectangular, regular and irregular polygonal, ellipsoidal, and multi-compartment and multi-sectional containers. The multi-compartment and multi-sectional containers are contemplated as having the same or different shapes for each compartment or section. Compartments may include internal divider panels and sections may be separated areas within the container.

Referring to FIG. 20, FIG. 20 illustrates the pull-tab assembly 46 is alternately connected to the base peripheral rim 88 by the hinge 76, and the lower wall of recessed rim channel 77 is also formed as a mirror-image (inverted) profile matched and fitted over the lid peripheral rim 75 in a closed position. This important invention feature is required for the alignment of the locking (male-female) connector 63 for the round container, however, it is commonly understood that the lid orientation is appropriately aligned to the base for all square, rectangular, elliptical, polygonal, and multi-compartment or multi-sectional containers.

Figure 21:
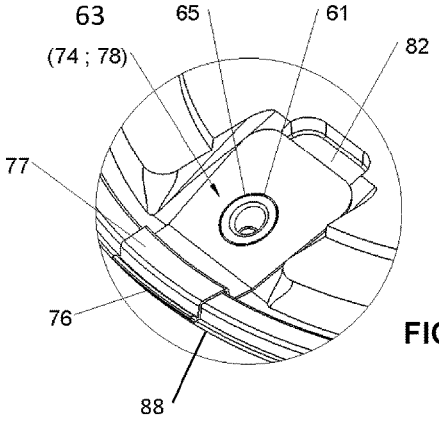
FIG. 21 is an enlarged detail view of the pull-tab assembly 38 disposed on the lid, which connects to the base by a foldable or perforated hinge, and having a locking male-female connection with a breakable/frangible joint between them; wherein the pull-tab has an inverted matching channel that fits closely on the rim of the lid, and the pull-tab assembly 38 is recessed between the protected walls.

Referring to FIG. 21, FIG. 21 illustrates another preferred embodiment of the pull-tab assembly 46 having a locking (male-female) connection 63 connecting the pull-tab to the lid recess. A precut channel 61 is radially disposed outside the locking male-female connection, the breakable/frangible joints 65 are connected between the hold down and the pull-tab assembly in a closed position. By pulling/lifting the pull-tab 79 (see FIG. 19) upwardly away from the lid, this motion causes breaking of the frangible joint 65 disconnecting the pull-tab away from the hold down. This important invention feature displays in one non-limiting aspect yet another indication of the tamper resistant/evident plastic container.

Although exemplary and preferred aspects and embodiments of the present invention and forming methods have been described with a full set of features, it is to be understood that the disclosed container and method of manufacture may be practiced successfully without the incorporation of each of those features. The scope of the present invention is not limited only to the tamper-resistant/evident containers and methods of manufacture disclosed herein. Thus, it is to be understood that modifications and variations may be utilized without departure from the spirit and scope of the invention and method disclosed herein, as those skilled in the art will readily understand. Such modifications and variations are considered to be within the purview and scope of the appended claims and their equivalents.

We claim:

1. A tamper evident pull-tab for a container comprising:

a pull-tab connected at a first end by a resilient living hinge to an edge of a first part of a two part container, the pull-tab also connected along one side of the pull-tab to the edge of a first part of a two part container by an outer pre-cut channel with breakable joints disposed within the outer pre-cut channel, the pull-tab having an upper surface with a pull-tab grip at a second end and having a pre-cut aperture channel at a mid-section with breakable joints disposed within the pre-cut aperture channel, a lower surface of the pre-cut aperture channel is configured with a male-female connector having a tensioning element around its circumference, and a base-tab connected to an edge of a second part of the two part container and aligned with the pull-tab, the base-tab having a recessed sidewall and an upper wall that forms a locking male-female connection aligned with the pull-tab male-female connector, and the base-tab having recessed sidewalls, a recessed lock upper wall that having an outer circumference larger than the circumference of the pre-cut aperture channel, the base-tab also having a support pier on the upper wall of the base located to be in operative association with the lower wall of the second end of the pull-tab, the support pier having a height above the upper wall of the base-tab greater than the height of the recessed sidewalls, and the base-tab having a finger grip adjacent the support pier, wherein the tension of joining the raised pull-tab with the locking male-female connector is greater than the combined strength of the breakable joints in both the pre-cut aperture channel and the outer pre-cut channel.

2. The tamper evident pull-tab for a container of claim 1, wherein the recessed lock upper wall is lower than the support pier and causes a lifting tension of the pull-tab, and the pull-tab is raised above and separated from the holddown by pulling the pull-tab upwardly and severing the breakable joint.

3. The tamper evident pull-tab for a container of claim 1, wherein the recessed lock upper wall and an outer circumference is larger than the circumference of the pre-cut aperture channel to prevent the pull-tab reattaching with the hold-down or fitting over the top of the outer circumference of the lock upper wall.

4. The tamper evident pull-tab for a container of claim 1, wherein the container is having a pull-tab assembly located at the center between the corners or near to a corner or at a corner of the container.

5. The tamper evident pull-tab for a container of claim 1, wherein the container is a hinged container.

6. The tamper evident pull-tab for a container of claim 1, wherein the container is a two-part, un-hinged container.

7. The tamper evident pull-tab for a container of claim 1, wherein the first part and the second part of two-part container have sidewalls defining matching, aligned four corners, at least one corner of the first part of the two-part container having a first component of a two-part snap-lock mechanism, and at least one corner of the second part of the two-part container having a matching second component of a two-part snap-lock mechanism.

8. The tamper evident pull-tab for a container of claim 1, wherein the resilient living hinge pulls and maintains the pull-tab upwards at an angle larger than 15% when the pull-tab has been separated from a connected pull-tab/base-tab combination.

9. The tamper evident pull-tab for a container of claim 1, wherein the living hinge is a double foldable hinge.

10. The tamper evident pull-tab for a container of claim 1, wherein the pull-tab and the base-tab are disposed outside the perimeter of the axial circumference of the container.

11. The tamper evident pull-tab for a container of claim 1, wherein the pull-tab is disposed within a recessed area of the container, the recess having walls to prevent accessing the pull-tab laterally.

12. The tamper evident pull-tab for a container of claim 1, wherein the resilient living hinge is laterally tensioned to prevent re-connecting the pull-tab to the base-tab when the pull-tab and the base-tab have been separated from a connected pull-tab/base-tab combination.

13. The tamper evident pull-tab for a container of claim 1, wherein the container is produced by the thermoforming process.

14. The tamper evident pull-tab for a container of claim 1, wherein the pre-cut aperture channel has an open-channel area devoid of breakable joints, wherein the open-channel area is adjacent the raised pull-tab grip.

15. The tamper evident pull-tab of claim 1, where the breakable joints of the pre-cut aperture channel are in a staggered configuration.

16. The tamper evident pull-tab for a container of claim 1, where the breakable joints of the pre-cut aperture channel are in an off-set staggered configuration wherein only one breakable joint at a time is encountered in the pre-cut aperture channel the pull-tab is actuated.

17. A container having a tamper evident pull-tab, comprising:

a pull-tab connected at a first end by a resilient living hinge to an edge of a first part of a two part container, the pull-tab also connected along one side of the pull-tab to the edge of a first part of a two part container by an outer pre-cut channel with breakable joints disposed within the outer pre-cut channel;

the pull-tab having an upper surface with a pull-tab grip at a second end and having a pre-cut aperture channel at a mid-section with breakable joints disposed within the pre-cut aperture channel, on a lower surface of the pre-cut aperture channel is configured with a male-female connector having a tensioning element around its circumference; and a base-tab connected to an edge of a second part of the two part container and aligned with the pull-tab, the base-tab having a recessed sidewall and recessed lock upper wall that forms a male-female connection with the pull-tab of the first part, the sidewalls of the recess having an upper wall with an outer circumference larger than the circumference of the pre-cut aperture channel, the base-tab also having a support pier on the upper surface of the base located to be in operative association with the lower surface of the second end of the pull-tab, the support pier having a height above the upper surface of the base-tab and greater than the height of the recessed sidewalls, and the base-tab having a finger grip adjacent the support pier;

wherein the first part of the two-part container and the second part of the two-part container are joined along part of the edge by a foldable hinge; and wherein the tension of joining the raised pull-tab forming the male-female connector is greater than the strength of the breakable joint.

18. A container having a tamper evident pull-tab of claim 17, wherein the pre-cut aperture channel has an open-channel area devoid of breakable joints, wherein the open-channel area is adjacent the raised pull-tab grip.

19. A container having a tamper evident pull-tab of claim 17, wherein the breakable joints of the pre-cut aperture channel are in a staggered configuration.

20. A container having a tamper evident pull-tab of claim 17, wherein the breakable joints of the pre-cut aperture channel are in an off-set staggered configuration wherein only one breakable joint at a time is encountered in the pre-cut aperture channel when the pull-tab is actuated.

21. A container having a tamper evident pull-tab of claim 17, wherein the container of two-part is a hinged container.

22. A container having a tamper evident pull-tab of claim 17, wherein the container of two-part is an unhinged container.

23. A method of making a tamper resistant container, comprising the step of providing a lid for a base, said lid having a two-component pull-tab attached to an edge of the lid, wherein said two-component pull-tab is used to pull the lid off the container, wherein both components of the pull-tab, an outer section and an inner tab, stay connected to the edge of the lid, wherein the outer section and the inner tab of the pull-tab are connected by a frangible break line, wherein the inner tab is secured to the lid using a button on an underside of the inner tab that fits into a recess on a top of the lid, wherein the act of pulling the pull-tab breaks the outer section away from the inner tab, wherein the outer section is only connected to the inner tab, and the pulling of the outer section against the buttoned inner tab breaks the frangible line, and wherein once the frangible section is broken, provides evidence that the container was opened by showing that both parts of the pull-tab assembly are now separated, with the inner tab button-locked into the lid, and wherein the outer section has a tensioned hinge wherein, upon separation from the inner tab, the released outer section is bent upwards at an angle.

* * * * *